US005986872A

United States Patent [19]

Chaput

[11] Patent Number: 5,986,872

[45] Date of Patent: Nov. 16, 1999

[54] MULTI-COMPONENT ELECTRIC STUNNING UMBRELLA

[76] Inventor: Eugene M. Chaput, 358 Alamos Rd., Portola Valley, Calif. 94028

[21] Appl. No.: 09/156,519

[22] Filed: Sep. 17, 1998

Related U.S. Application Data

[60] Provisional application No. 60/060,582, Oct. 1, 1997.

[51] Int. Cl.[6] ..... H05C 1/06; A45B 3/02

[52] U.S. Cl. ..... 361/232; 135/16

[58] Field of Search ..... 361/232; 42/1.08; 463/47.2–47.4; 135/16–18; 89/1.11

[56] References Cited

U.S. PATENT DOCUMENTS 3,819,108 6/1974 Jordan .
4,093,969 6/1978 Maynor, Jr. .
4,162,515 7/1979 Henderson et al. .
4,962,779 10/1990 Meng .
4,968,034 11/1990 Hsieh .
5,041,951 8/1991 Fan .
5,282,332 2/1994 Philips .
5,388,603 2/1995 Bauer et al. .

*Primary Examiner*—Jeffrey Gaffin
*Assistant Examiner*—Kim Huynh
*Attorney, Agent, or Firm*—Feix & Feix

[57] ABSTRACT

A personal accessory comprises a multi-component electric stunning umbrella which can be carried as a personal accessory without attracting attention, which can be used as a conventional umbrella, and which can also be used for self defense. The stunning umbrella proves a stunning but non-lethal electrical shock when used for self defense and can also be used as a baton or striking implement.

9 Claims, 3 Drawing Sheets

MULTI-COMPONENT ELECTRIC STUNNING UMBRELLA

This application claims the priority of my Provisional Application Ser. No. 60/060,582 filed Oct. 1, 1997.

BACKGROUND OF THE INVENTION

This invention relates to a personal accessory which can be used for self-defense.

This invention relates particularly to a personal accessory which comprises a multi-component electric stunning umbrella which can be used to provide a stunning but non-lethal electrical shock for self-defense.

This invention is designed to provide a measure of protection against a society that is becoming increasingly more violent and intolerant, particularly in the major cities and growing suburban areas. Personal bodily attacks are common and everyday occurrences; and, unfortunately, most individuals and especially women are at the mercy of the attacker with little means whatsoever to defend or protect themselves.

Therefore it is the object of the invention to be described herein to provide a means of defense whereby the carrier of the personal accessory of this invention would be able to ward off an attack with a great degree of success without any significant strength, dexterity or training required.

It is a related object to give the user the knowledge and confidence that the personal accessory could go beyond the defense mode to one with a superior offensive capabilities and yet be non-lethal.

The personal accessory of this invention to be described is disguised as a benign, innocuous, common, every day, personal accessory that would not draw attention to itself or the user and that would be carried outside the person and that would be readily accessible in the event of an attack. Although its primary intent is to serve as a self-defense weapon, the invention is designed to function as the accessory it resembles and, as such, is a multi-purpose, multi-use product.

The self-defense weapon is a high-voltage (e.g., 100,000 volts) electronic stun gun disguised in the form of a compact umbrella with electrical probes protruding from the canopy end that carry a stunning but non-lethal electronic shock while also providing a very frightening and vivid (audible and visual) high voltage display. The electrical probes protruding from the canopy end produce a stunning electrical shock to an assailant when those probe means are physically engaged with the assailant and when the trigger is actuated to transmit a high voltage to the electrical probes which are physically engaged with the assailant. The very frightening (audible and visual) high voltage display can be produced by actuating the trigger without having the protruding electrical probes physically engaged with the assailant. This high voltage display is produced by two probes which are in addition to the protruding probes and which produce an arc between the two additional probes when the trigger is depressed without the stunning weapon being physically engaged with the assailant. The stunning weapon has an opening at its distal end through which the arc between the two additional probes is visible by an assailant.

The handle that houses the electronic components and trigger system contains a detachable wrist lanyard, which when disconnected from its handle receptacle by way of a simple press-fit jack configured arrangement, renders the electronic shocking aspect of the device inoperable. This acts as a safety feature in the event the umbrella is pulled away or, in some way, removed from the owner's control. It also is a safety feature when it is to be used as an umbrella or stored.

As additional protection, a positive on-off safety switch is located directly below the trigger to further insure the device will not operate inadvertently.

A hard plastic removable sleeve with an overlayment of cloth (designed to resemble and masquerade as a conventional umbrella cover) serves as a protective cover for the umbrella canopy. The sleeve is electrified by means of conductive strips running along its length and connected to the stunning probes at the distal end by way of a positive system of spring pressure contacts. This, in effect, allows the entire exterior of the umbrella (excluding the handle section) to be electrified. Thus, the exterior cover sleeve can be activated by the same trigger system that operates the canopy end shocking probes. By electrifying the cover sleeve, an attacker is prevented from grasping the umbrella to wrest it away.

This hard plastic sleeve is firmly secured to the handle of the umbrella with simple detent spring ball clips or by a Velcro™ retaining strap arrangement. This allows the umbrella to be further used as a baton or striking implement, should the need for this type of defense arise.

To provide additional versatility, this hard plastic sleeve can be easily removed and used independently as a baton while the electronic umbrella is used simultaneously as a shocking and distracting/disorienting weapon.

Importantly, the umbrella portion of the device (staves, stem, actuating mechanism and canopy) is fully functioning for rain protection while concurrently serving as an extremely effective self-defensive weapon with or without the cover sleeve.

A PERSPECTIVE OF THE PRESENT INVENTION VS. PRIOR ART

U.S. Pat. No. 5,388,603 to Bauer, et al. (1995) describes a multi-use shocking umbrella which may be used as a truncheon, but which has the umbrella canopy portion folding into the handle which itself is the truncheon. As such, this truncheon cannot be removed or separated from the umbrella. While using this particular device as a truncheon, the possibility exists that the umbrella will release and unfurl thereby obstructing the wielder's vision and considerably slowing the movement and effectiveness of the truncheon; but, more significantly, will render the device inoperable as a stunning/shocking weapon, because the unfurled umbrella will block or interfere with the electrified tubing 12 which extends beyond the shaft base 1B.

When the umbrella 10 is intentionally unfurled, the Bauer, et al. device also cannot be used as a stunning/shocking device.

Another disadvantage of the umbrella of the Bauer, et al. patent is that the trigger system consists of two opposing triggers both of which must be squeezed simultaneously to activate the shocking feature of the device. This system is neither fool-proof, nor safe, nor easy to operate in a crisis situation; and this system does not provide an effective electronic disengagement system should the device be taken away by the attacker. In effect, this Bauer, et al. trigger system has no provision for a positive "off" feature to totally inactivate the stunning portion of the weapon in the event the weapon is snatched from the user. Further, a trigger safety and/or positive "off" system is essential in case both switches were to be inadvertently "triggered" (e.g., in a crowded situation such as publication transportation, etc.). Importantly, this dual trigger system of the Bauer, et al. patent does not provide a positive safety mechanism to completely disarm the electric system of the weapon should a child accidentally find and attempt to operate the device. This lack of a positive "off" feature is a definite safety deficiency of the stunning umbrella product disclosed in the Bauer, et al. patent.

Most importantly, however, in the Bauer, et al. product, the umbrella end itself is not electrified. There are no contact probes at the distal end of the umbrella. The only electrical contact surface is the flat outer circular distal end of the cover tubing 12. This is a serious deficiency in the Bauer, et al. design and severely compromises the intended purpose of the device. From a practical standpoint, because there are no end probes and the only electrified contact surface is merely the cylindrical flat surface of the tubing 12, there is no absolute system of contact against an attacker. This is especially critical should there be any rocking movement which could cause the distal end of the Bauer, et al. tubing 12 to be other than perfectly flush with the person of the attacker. Any such rocking movement could result in inadequate or insufficient contact, and the weapon will not function as intended. This would be of particular concern if the user had to penetrate clothing (which is the usual situation). There simply would not be any conductivity to the skin and this would render the device dysfunctional.

In contrast, the product of the present invention relies on protruding probes to provide for the possibility of motion and to insure proper and positive conductivity.

Also, the lack of protruding end probes in the Bauer, et al. patent does not allow for visual sparking across the probes. Visual sparking can be crucial to the deterrent effect of a stunning device. Visual sparking is also useful to insure the weapon is functioning (i.e., sparking) properly.

The present invention includes visual and audible sparking test probes.

SUMMARY OF THE PRESENT INVENTION

The present invention comprises a multi-purpose, multi-use device that includes the following features and advantages:

(a) provides an effective hand-held weapon that is easy to use and operate and does not require any special skills, training or physical attributes;

(b) provides a non-lethal self defense tool through the medium of electronic shock/stunning technology that is legal to carry, lightweight and does not attract attention in the form in which it normally appears;

(c) provides sufficient distance between the user and the assailant to prevent the assailant from being able to physically grab the user;

(d) provides an additional measure of protection by allowing the weapon to be used as a baton;

(e) provides the user with a fail safe system of rendering the shocking portion of the device in operable through the use of a positive "off" safety system lanyard contact jack to disengage the power if the weapon is inadvertently or unintentionally seized from the user or when it is deemed necessary to deactivate the weapon such as for storage, battery removal, etc.;

(f) embodies a contact jack lanyard which can be firmly affixed to a clip designed into the base of the handle to prevent accidental release of the jack from the contact point should the weapon be used as a baton. (This insures the weapon will remain in the user's grasp and will be effective as a stunning or shocking weapon and will prevent the contact jack from accidentally becoming disengaged);

(g) allows the user to keep the weapon on active status by incorporating an additional sliding "safety" positioned in the handle below the trigger;

(h) allows for a separate hard plastic cover sleeve that carries electrodes along its length so as to also be electrified through a positive contact system at the distal end of the umbrella. (This hard plastic cover sleeve can be removed at the user's discretion without compromising the effectiveness of the umbrella's shocking system);

(i) provides a highly effective deterrent in the form of an electrified spark that is both visually and audibly impressive that also serves as a test mode to show the weapon is functioning (stunning) properly;

(j) utilizes protruding end probes to insure contact and the resulting conductivity of the charge;

(k) utilizes a positive method of spring pressure contacts between the hard plastic cover sleeve and the end probes to insure conductivity along the length of the cover;

(l) operates as a fully-functioning compact umbrella.

Methods and apparatus which incorporate the features described above and which are effective to function as described above constitute further, specific objects of the invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 shows the umbrella extended in its umbrella mode of operation.

In FIG. 3 the top end of the figure has been broken away and has been shown in cross section to illustrate details of the construction structure of that end portion of the cover sleeve.

FIG. 3B shows structural details of how the probes of the electronic stunning umbrella extend through the end of the hard plastic cover sleeve when the electronic stunning umbrella is in the collapsed state shown in FIG. 2.

DETAILED DESCRIPTIONS OF THE PREFERRED EMBODIMENTS

Figure 1:
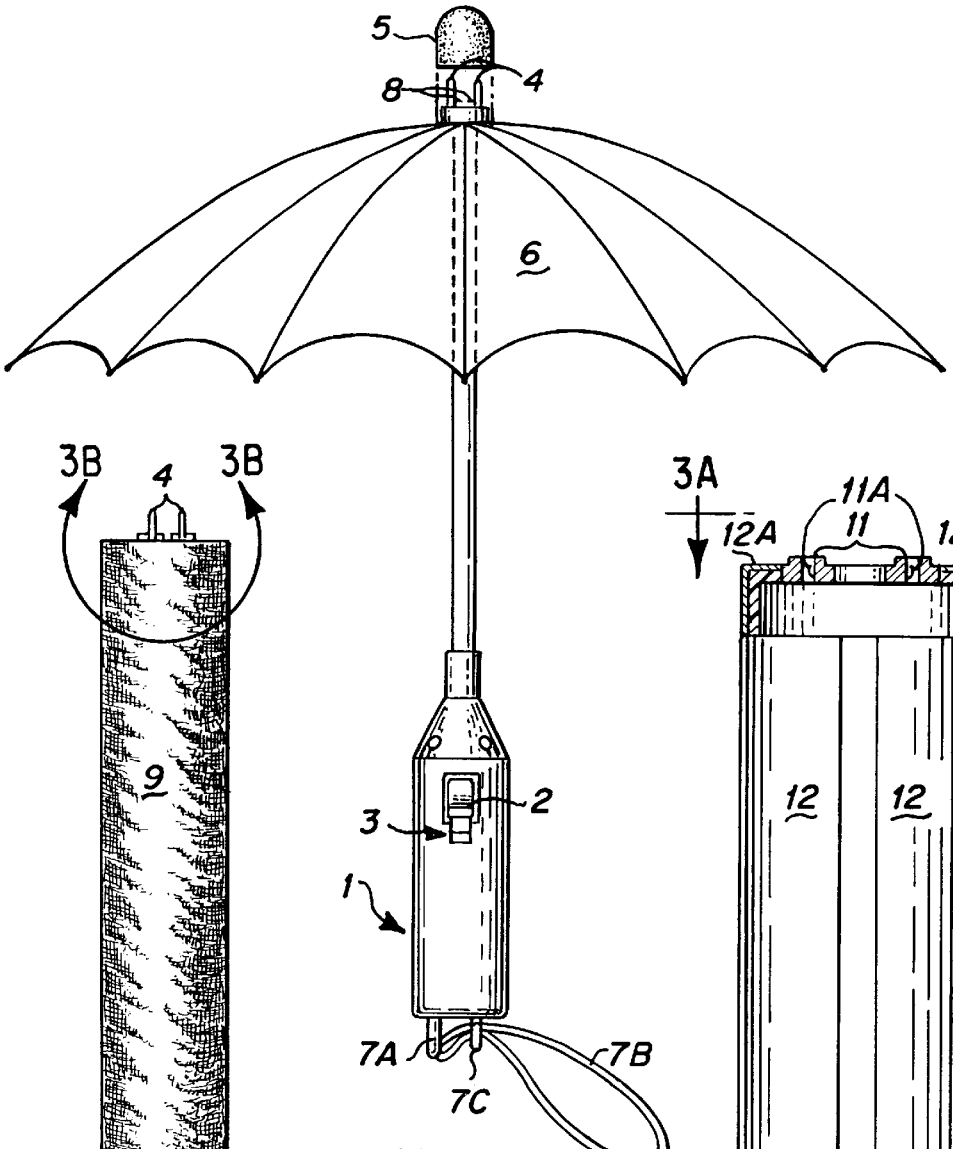
FIG. 1 is a side elevation view of a multi-component, electric stunning umbrella, personal accessory constructed in accordance with one embodiment of the present invention.

The following table is a listing of the components indicated by the indicated reference numerals in the drawing figures.

FIG. 1

1. Umbrella handle including stun gun components (i.e., electronic stunning circuitry, trigger, trigger safety, lanyard contact jack positive "off" safety and battery);

2. actuating trigger;

3. trigger sliding safety;

4. electronic "stunning" contact probes"; the stunning contact probes 4 produce a stunning electrical shock to an assailant when the probes 4 are physically engaged with the assailant and when the trigger 2 is actuated to transmit a high voltage (e.g., 100,000 volts) to the probes 4.

5. hard rubber/plastic removable contact probe protector;

6. umbrella canopy (open);

7A, 7B, 7C positive "off" safety system

7A lanyard contact jack;

7B wrist lanyard; and

7C lanyard securing clip/clasp;

8. test mode sparking probes. The test mode sparking probes 8 are electrically connected with the stunning probes 4. When the trigger 2 is actuated to transmit a high voltage to the stunning probes 4, a vivid (audible and visual) high voltage display arc is produced between the test mode sparking probes 8. This arc is visible to an assailant through the opening 8A in the hard sleeve 9 (when the hard sleeve 9 is assembled on the collapsed compact umbrella) and the arc is also visible to an assailant when the compact umbrella does not have the hard sleeve 9 in place. The arc is produced when the trigger 2 is actuated, so the protruding probes 4 do not have to be physically engaged with the assailant. This vivid high voltage display may, in itself, be a deterrent to an assailant.

FIG. 2

9. Fabric covered hard plastic (Lexan™) cover sleeve;

10. Velcro™ end closure to secure hard cover sleeve to umbrella handle.

FIG. 3

11. Positive contact feed-through connectors;

11A. spring pressure contacts;

12. conductive foil bonded to outside of plastic umbrella cover sleeve. (Gap between foil prevents shorting of high voltage);

13. hard plastic (Lexan™) sleeve body (approximately 2¼" diameter).

Figure 3A:
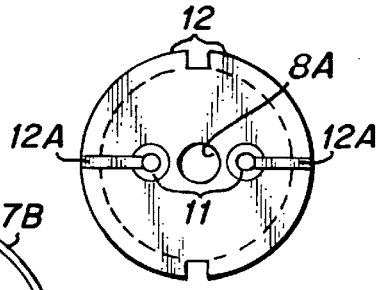
FIG. 3A is an end elevation view taken along the line and in the direction indicated by the arrows 3A—3A in FIG. 3.

FIG. 3A (Distal end view of hard plastic sleeve showing connectivity detail.)

12A Conductive foil strip continues across end to make positive contact with feed-through connectors 11 which include spring pressure contacts 11A.

Figure 3:
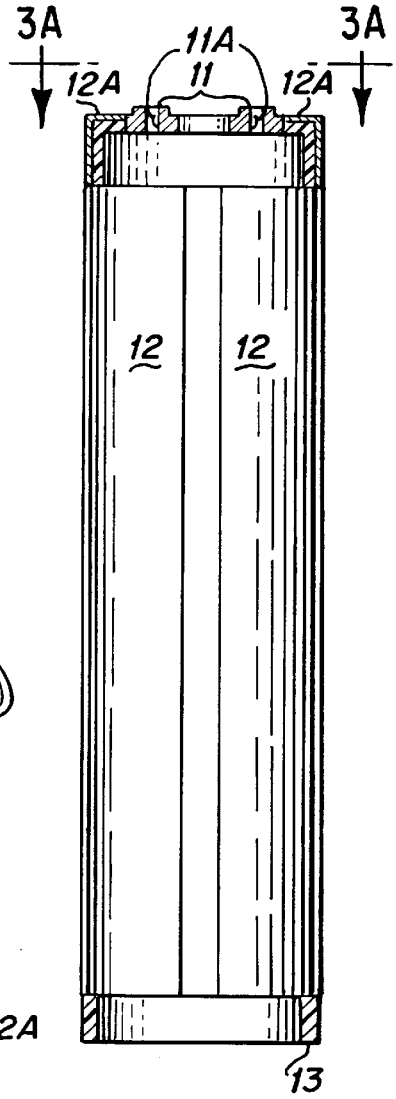
FIG. 3 is a side elevation view of the fabric covered hard plastic cover sleeve shown in FIG. 2.
Figure 3B:
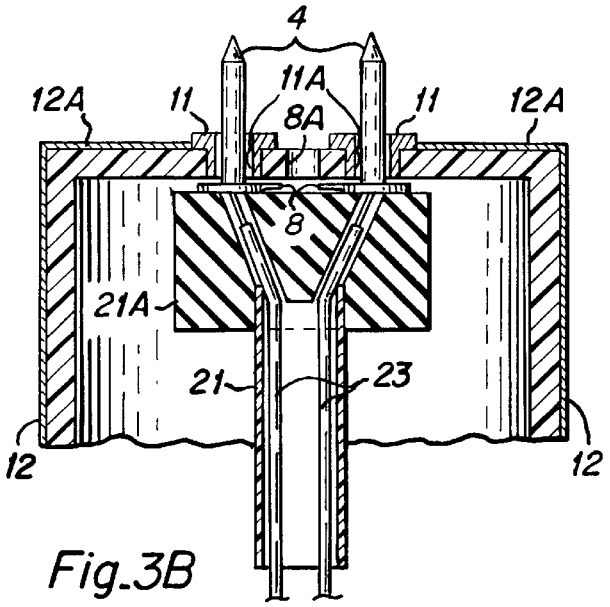
FIG. 3B is a fragmentary, enlarged, side elevation view in cross section of the portion of the cover sleeve shown encircled by the arrows 3B—3B in FIG. 2.

FIG. 3B (Connection detail of electrified umbrella end with hard plastic sleeve in place.)

21. Umbrella shaft;

21A. insulated umbrella tip;

12A. conductive foil strip;

11. electrical feed-through connector;

11A. spring pressure contacts;

8. test mode sparking probes;

8A. opening in the sleeve for seeing the spark between the test mode sparking probes 8;

4. electrified conductive probes;

12. conductive foil;

23. high voltage lead wires.

Figure 4:
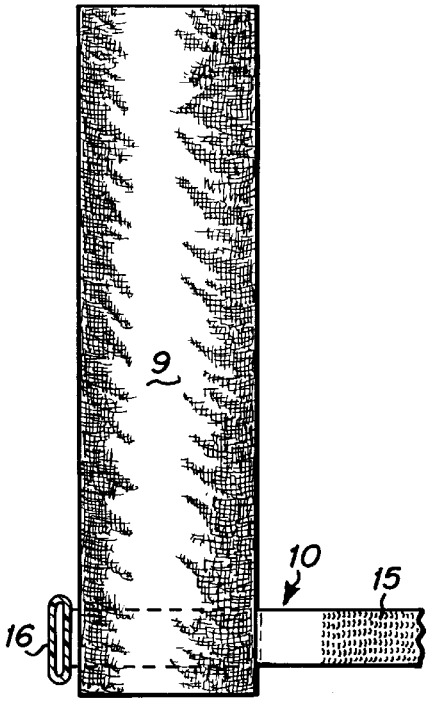
FIG. 4 is a side elevation view of the fabric covered hard plastic cover sleeve.

FIG. 4 (Hard plastic sleeve with fabric cover)

15. Velcro™ tab/strap for closure and attachment to umbrella handle;

16. loop end for closure strap.

Figure 5:
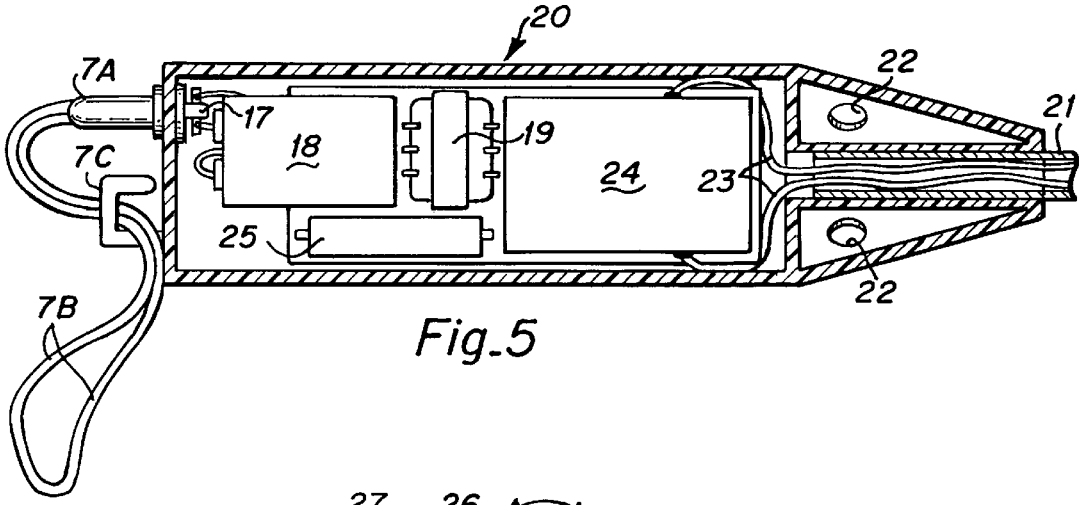
FIG. 5 is an enlarged, broken away, side elevation view of the handle portion of the stunning umbrella showing details of electrical components for producing the electrical shock and the electrical disengagement safety system(s).

FIG. 5 Electrical Components

7A Positive "off" safety system lanyard contact jack;

7B wrist lanyard;

7C lanyard clip or clasp;

17. contact jack safety interrupt;

18. power source (i.e., 9 volt battery);

19. primary transformer;

20. plastic molded handle contains electronic components and trigger/safety system;

21. umbrella shaft;

22. case-securing screw receptacles;

23. high voltage leads;

24. high voltage (step-up) transformer;

25. capacitor.

Figure 5A:
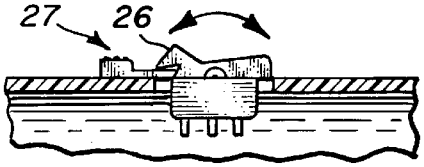
FIG. 5A is an enlarged side elevation view of a safety structure for locking the activating trigger switch in an "off" position.
Figure 6:
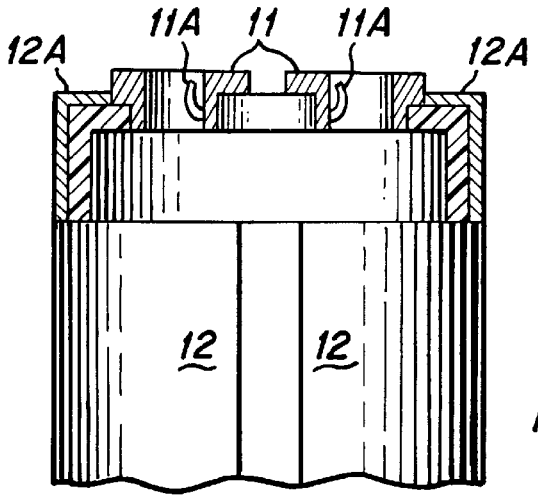
FIG. 6 is an enlarged view of the top part of FIG. 3 showing the spring pressure contacts within the positive feed through connectors.
Figure 7:
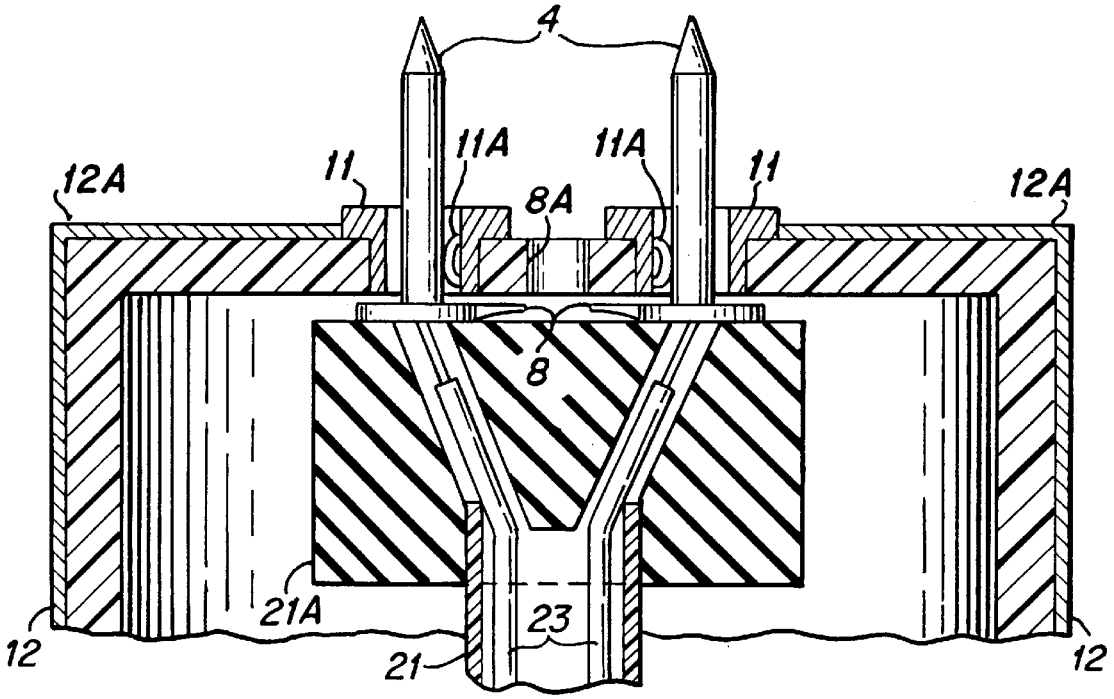
FIG. 7 is an enlarged view of the top part of FIG. 3B showing the spring pressure contacts within the positive feed through connectors.

FIG. 5A (Trigger detail)

26. Trigger (rocking switch);

27. sliding safety to block trigger.

The following description discloses the preferred embodiments of the present invention with reference to the drawing views. The illustrations show the specific elements of the preferred, best mode embodiments of the invention.

FIG. 1 illustrates the electronic stunning umbrella without the outer cover sleeve in place and the umbrella canopy open. The handle 1 is shown including the actuating trigger 2, the trigger sliding safety mechanism 3 and the positive "off" safety system 7A, 7B, 7C. See FIG. 5 for specific operating components such as detail of the contact jack 7A, wrist lanyard 7B and fixing clasp/clip 7C, the various electronic components used to energize the device and the trigger/safety system.

Figure 2:
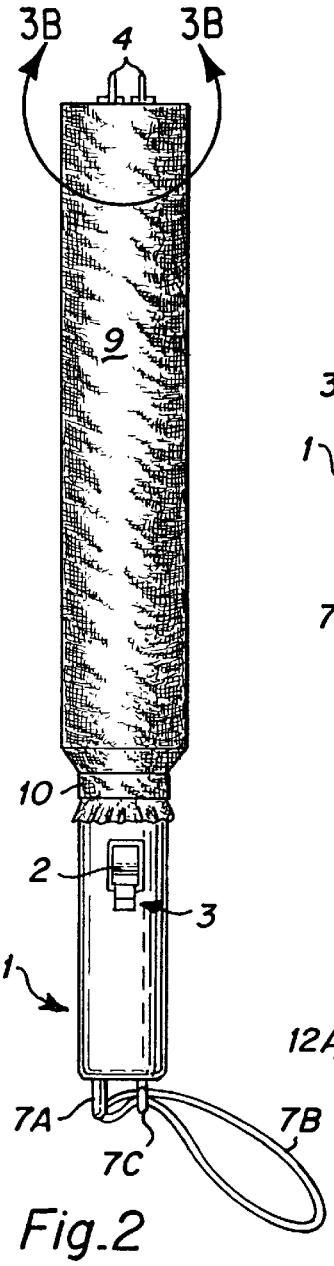
FIG. 2 is a side elevation view of the embodiment shown in FIG. 1, but FIG. 2 shows the umbrella in a collapsed state with a fabric covered, hard plastic cover sleeve installed over the collapsed umbrella.

FIG. 2 illustrates the electronic stunning umbrella in a collapsed state with the fabric covered hard plastic cover sleeve 9 installed. The electronic stunning probes 4 are visible at the distal end of the umbrella. The sparking test probes 8 are shown and described in detail in FIG. 3B. The Velcro™ closing arrangement 10 (to affix the fabric covered hard plastic sleeve to the umbrella) is shown in a secured position (i.e., over the umbrella canopy).

FIG. 3 illustrates the details of the hard plastic cover sleeve made of 3/32" Lexan™ 13 or similar material in the form of a sleeve closed at one end. Conductive foil is bonded to its outside diameter 12. These foil areas are electrically linked to the feed-through connectors 11, 11A that pick up the high voltage from the umbrella distal end protruding probes 4 whenever the device is triggered. The detail of the feed-through connectors 11, 11A is shown with FIGS. 3A, 3B depicting the end view detail. FIG. 3B shows the umbrella distal end stunning probes and test spark gap detail encapsulated within and protruding through the hard plastic sleeve. This allows for the electrification of the sleeve while maintaining conductivity at the stunning probes. As shown in FIGS. 3 and 3A the feed through connectors 11 may have spring pressure contacts 11A for insuring that the conductive strips 12A electrify the foil 12 of the sleeve.

FIG. 4 illustrates the fabric cover which is bonded to the cylindrical outer surface of the hard plastic cover sleeve to simulate a conventional umbrella cover. The Velcro™ end tab/strap 15 and the securing loop 16 are shown which firmly affix the hard plastic cover sleeve to the umbrella handle.

As best shown in FIG. 3*b*, the fabric covered plastic sleeve 9 has two openings in the distal end through which the distal end electronic stunning probes extend, and also has an opening 8A through which the spark between the test probes 8 can be seen.

FIG. 5—The device itself consists of a handle in which are contained the electrical components commonly found in conventional stun guns utilizing solid state microchip technology much in the manner of currently available commercially-produced stun guns such as the Parali/Azer marketed through the Shamash International Group. The technology is based on a patent issued in 1979 to Henderson (U.S. Pat. No. 4,162,515). This U.S. Pat. No. 4,162,515 is incorporated by reference in this application. The electronics consist of a power source; in this case an alkaline 9 volt battery 18. The low voltage direct current generated by the battery is connected to an integrated circuit board 19 that converts this low direct current to an intermediate level which then multiples the current to an effective use level ±100,000 volts with minimal amp discharge. The step-up transformer 24 is wired to the external electrical probes located in the distal end of the umbrella. The handle also contains an exposed rocking trigger switch 26 to actuate the charge. Located below the trigger switch is a sliding safety 27 intended to block the trigger from making contact, when engaged, preventing any electrical discharge from occurring. Located in the bottom of the handle is a positive "off" safety system contact jack 7A which must be in place 17 to complete the circuit. When removed, the jack, acting like an automotive ignition key, will render the electrics inoperable thus providing a fool-proof safety mechanism further preventing accidental discharge or foiling activation against the user if taken away. If the umbrella is to be used as a baton or truncheon, a clip or clasp 7C is affixed to the bottom of the handle through which the lanyard 7B can be secured. When the lanyard is attached to the clasp, the weapon will be firmly secured to the user's wrist and cannot slip out of the user's grasp or be pulled away. Further, fixing the lanyard to the clasp allows the weapon to retain its stunning capability by assuring the lanyard contact jack will not dislodge from its contact insertion point in the handle.

SUMMATION

The device described is a fully functioning personal accessory (compact umbrella), but whose primary intent is to serve as a self-defense weapon with dual capabilities-that of a device able to deliver a potent yet non-lethal electronic stunning shock and a device that can be used as a baton to strike an assailant. The device differs from previously patented incarnations in several respects which materially improves the effectiveness, safety and overall characteristics of the weapon and results in a significantly differentiated and more reliable and usable product. The differences include:

(1) The primary contact surface of the distal end of the umbrella utilizes a system of protruding probes rather than a flat contact surface; these probes being an integral part of the umbrella. This renders the end of the umbrella electrically conductive which allows the umbrella itself to be used as a stunning weapon independent of the removable hard plastic cover sleeve.

(2) The baton portion of the device is a removable hard plastic sleeve covered with fabric that slides over the umbrella canopy and protects the umbrella canopy while also serving as a striking weapon. Further, this sleeve is electrified by way of feed-through connectors having a positive system of spring pressure contacts that pick up high voltage from the umbrella distal end protruding probes. This sleeve is attached to the umbrella handle but provides an added measure of versatility in that it can be removed from the umbrella to lighten the weight of the umbrella and can be used independently from the umbrella as a baton while the umbrella, itself, remains electrically active.

(3) The device is provided with a positive "off" disengagement system in the form of a wrist lanyard attached to the bottom of the umbrella handle through a simple jack arrangement. When the jack is removed, the electrical (stunning) system is disconnected and will not function.

(4) The wrist lanyard, however, can be secured to the clip or clasp molded to the end of the handle to insure the jack does not disengage in the event the device is to be used as a baton to strike an assailant while still providing the stunning or electrical shocking capability of the weapon.

(5) The handle incorporates an additional sliding "safety" below the trigger to maintain the weapon in an inactive mode.

(6) The two distal end test probes allow for a very vivid audio and visual test "spark" to insure the weapon is functioning and to act as a deterrent to a would-be attacker.

(7) A fully-functioning, compact umbrella uses a fixed (non-telescoping) shaft with the staves of the umbrella canopy opening as the center mounting hub slides up the shaft in the traditional manner of a compact umbrella.

While I have illustrated and described the preferred embodiments of my invention, it is to be understood that these are capable of variation and modification, and I therefore do not with to be limited to the precise details set forth, but desire to avail myself of such changes and alterations as fall within the purview of the following claims.

I claim:

1. A multi-component electric stunning weapon and striking baton disguised as a compact umbrella accessory device, said device comprising, umbrella means for producing a fully functioning rain shield when opened and also for producing a stunning electrical shock against an assailant whether opened or closed, said umbrella means having a canopy portion which is movable between an extended, open position and a folded, closed position, hard sleeve means configured to slide over the canopy portion in the closed position and constructed to enable the umbrella means to produce said stunning electrical shock with the hard sleeve means in place over the canopy portion, said hard sleeve means also being constructed to be entirely removable from the umbrella means, said hard sleeve means being constructed of a hard, non-deformable material which enables the hard sleeve means to be used as a striking weapon both when assembled with the umbrella means and when entirely separated from the umbrella means, said umbrella means including probe means for producing a stunning electrical shock to an assailant when the probe means are physically engaged with the assailant, said probe means comprising two electrically conductive probes projecting from the canopy end of the umbrella means for enabling sure, positive, physical contact of the two electrically conductive probes with the assailant, and test and display means for permitting visual and audible testing of the electric stunning capabilities of the umbrella means to be sure that the device is in operative condition and also for producing a vivid audible and visual high voltage display to an assailant without the need to have the two electrically conductive projecting probes physically engaged with the assailant.

2. The invention defined in claim 1 including trigger means which can be actuated to produce the stunning electrical shock.

3. The invention defined in claim 1 wherein the test and display means include two probes which are in addition to said probe means and which are also located on the canopy end of the umbrella means.

4. The invention defined in claim 1 wherein the hard sleeve means include an opening in the distal end of the hard sleeve means which is adjacent to the canopy end of the umbrella means and wherein said opening is large enough to permit said visual and audible testing and display of the test and display means.

5. The invention defined in claim 2 including double safety means for preventing accidental or unwanted stunning electrical shock, said double safety means including a sliding safety mechanism associated with said trigger means.

6. The invention defined in claim 5 including a handle and an electrical system within the handle and wherein the double safety means includes a removable jack in the handle which provides a positive off to the electrical system when the jack is withdrawn from the handle.

7. The invention defined in claim 6 including a lanyard connected to the handle and wherein the lanyard is also connected to said jack for pulling the jack from the handle.

8. The invention defined in claim 1 including conductive foil bonded to the outside of the hard sleeve means and including a positive spring pressure contact electrical connection from the umbrella means to the conduction foil for producing selectable high voltage electrification of the conductive foil.

9. The invention defined in claim 8 including a removable covering for the hard sleeve means which fabric covering conceals the conductive foil when the fabric covering is in place over the hard sleeve means.

* * * * *